US005269074A

United States Patent [19]

Sims et al.

[11] Patent Number: 5,269,074

[45] Date of Patent: Dec. 14, 1993

[54] SINGLE TIER DRYER SECTION FOR CURL CONTROL

[75] Inventors: Duke N. Sims, South Beloit, Ill.; Gregory L. Wedel, Beloit, Wis.

[73] Assignee: Beloit Technologies, Inc., Wilmington, Del.

[21] Appl. No.: 873,420

[22] Filed: Apr. 24, 1992

[51] Int. Cl.[5] ..... F26B 3/24

[52] U.S. Cl. ..... 34/117; 34/120

[58] Field of Search ..... 34/114, 115, 116, 117, 34/113, 120, 121, 123

[56] References Cited

U.S. PATENT DOCUMENTS 5,101,577 4/1992 Wedel ..... 34/117 X

OTHER PUBLICATIONS

Paper Age Nov. 1991, pp. 12–13 by Tim Bal and J. Yli-Kauppila.

"Effect of Water Retention Value (WRV) on The Paper Web Drying Process", by K. Przybysz & J. Czechowski: *Cellulose Chem. Technol.*, 20, 1986; pp. 451–464.

"Relation Between Drying Stresses and Internal Stresses and the Mechanical Properties of Paper" by M. Htun & A. de Ruvo; Published Sep. 1977; pp. 2–13; Conference Literature.

Paper given by Valmet at Apr. 1989 CPAA Printing Conference, untitled; pp. 1–14.

*Primary Examiner*—Henry A. Bennet

*Attorney, Agent, or Firm*—Dirk J. Veneman; Raymond W. Campbell; David J. Archer

[57] ABSTRACT

A drying apparatus is disclosed for drying a web of paper. The apparatus includes a plurality of top felted drying sections for drying the web. Each of the drying sections is arranged in succession such that the web is restrained against cross-machine and machine directional shrinkage during passage of the web through the plurality of drying sections. A further single drying section only is disposed downstream relative to the plurality of drying sections such that the web extends between the plurality of drying sections and the further drying section. The further drying section includes an upper tier of dryers and an upper plurality of rolls which are disposed between adjacent dryers of the upper tier. An upper felt extends alternately around each dryer of the upper tier and each roll of the upper plurality of rolls. The further drying section also includes a lower tier of dryers and a lower plurality of rolls disposed between adjacent dryers of the lower tier. A lower felt extends alternately around each dryer of the lower tier and each roll of the lower rolls. The arrangement is such that the web extends in open draw between each dryer of the upper and lower tiers so that any tendency of the web to curl is controlled during movement of the web through the further drying section.

13 Claims, 10 Drawing Sheets

SINGLE TIER DRYER SECTION FOR CURL CONTROL

BACKGROUND OF THE INVENTION

1. Field of the Invention

The present invention relates to a drying apparatus for drying a web of paper. More particularly, the present invention relates to a plurality of single tier, top felted dryers followed by one double tiered drying section.

2. Information Disclosure Statement

In the manufacture of lightweight paper grades, such as newsprint and fine paper, the web is dried on a series of steam-heated drying cylinders. The wet web is pressed directly onto the cylinders by a series of tensioned, permeable fabrics or felts.

In a conventional double-felted, two tier dryer section, the wet web passes from one cylinder to the next in a generally serpentine fashion through long, unsupported "open draws". The majority of the water vapor that leaves the sheet or web is released in these open draws.

Problems have been experienced during operation of conventional dryer sections with regard to sheet flutter during movement of the web through such open draws.

Also, in conventional dryer sections, problems are caused by cross-directional sheet shrinkage and inefficient ventilation of evaporated water.

Additionally, conventional drying sections of the aforementioned type typically require threading ropes in order to thread a tail of the web through such dryer sections.

Some of the problems with sheet flutter, sheet shrinkage, and vapor ventilation have been solved by extending the length of the single tier, top felted, sections known in the art as "BelRun" sections, to include more of the drying cylinders. However, the primary concern with extending the number of top felted sections so far down the length of the dryer section is that an imbalance in drying on each side of the web was expected to cause a problem with sheet curl.

Typically, with the aforementioned arrangement, approximately 41 percent of the dryers are disposed in a single tier configuration, and the remaining 59 percent are arranged as two tier, double felted dryers.

The problems associated with the conventional two tier dryer sections and the extended "BelRun" dryer sections have been solved with the use of the so-called "Bel-Champ" dryer section. Bel-Champ is a common law trademark of Beloit Corporation. The Bel-Champ TM dryer section utilizes a series of single tier dryer sections, generally disposed horizontally, such drying sections drying alternate sides of the web.

More specifically, the web is conveyed between cylinders in the Bel-Champ TM dryer section using the direct support by the dryer fabrics. Two-sided drying is achieved by alternating between top felted and bottom felted sections. The web is transferred between these opposite felted sections using a unique transfer arrangement. Sheet restraint is provided using the combination of felt tension pressure against the web on the cylinders, and vacuum pressure against the web on the intermediate vacuum transfer rolls. Such continuous support of the web also permits threading of the sections without the use of threading ropes.

Nevertheless, a consideration of the aforementioned Bel-Champ TM geometry is that there is an added machine length resulting from having all of the dryers in a horizontal arrangement rather than in a two tier arrangement.

A further consideration of the Bel-Champ TM configuration is that each of the section-to-section transfers normally requires two vacuum rolls.

Additionally, another consideration of the aforementioned arrangement is that, in the event of the web breaking and wrapping a bottom felted dryer, the wrapped paper cannot be easily dumped into the basement. Rather, such broke must be manually removed from the bottom felted dryer section.

Also, in the Bel-Champ TM arrangement, control of curl of the web cannot be provided within a single section, but rather must be effected during movement of the web through at least two adjacent sections.

The present invention provides a unique arrangement of top felted, single tier dryer sections which end with a single, two tier section. The aforementioned arrangement provides good dryer access, efficient broke removal, direct access for operation, ropeless threading and efficient curl control.

More specifically, the dryer section of the present invention consists of a series of single-tier dryer sections with the dryers preferably disposed horizontally. The dryer sections are arranged with all the section-to-section transfers located for direct access from the main operating floor. Such transfers include the press-to-dryer section transfer, the dryer-to-dryer section transfers and the dryer-to-calender section transfer.

Broke handling and removal from all of the top felted sections is done in a downward direction, thus eliminating the need for extensive scaffolding, operator platforms and conveyors which would be required for efficient access around bottom felted sections.

Additionally, the arrangement of the present invention reduces the overall length of the paper machine due to the stacking of the dryers in the two tier section. Such arrangement also achieves high average felt wrap angles on the dryer cylinders for improved drying rates, improved drivability and improved sheet restraint.

Furthermore, the proposed dryer section provides enhanced two-sided drying for improved curl control, using the last dryers in the two-tier dryer section for such control. The last dryers have been found to be the most effective in terms of curl control.

Applicants have discovered that the single tier dryer sections, according to the present invention, are effective in reducing cross-directional shrinkage in the wet end of the dryer section. However, it has been further discovered that such single-tier dryer sections have less effect in the last dry end section.

Comparative test results from trials indicate that for a Bel-Champ TM type dryer section, the cross-directional shrinkage is nearly zero (0) until the web dryness reaches a level of about 65 to 80 percent dry. After this point in a single tier section, the cross-machine direction (CD) shrinkage increases, although at a rate that is less than the shrinkage rate of a web dried with a conventional dryer section, that is a double felted, two tier dryer section. Such shrinkage occurs even though the Bel-Champ TM dryer section is utilized. For this reason, little loss in web width will occur even though the last dryer section, according to the present invention, is arranged in a two tier configuration.

Furthermore, the two tier section provides an open draw location for the provision of a tail cutting mechanism. At the same time, the dryers in the two tier section are arranged with the felt rolls offset so as to reduce the length of the open draws in order to maintain sheet stability and to direct the tail into the next felt/dryer nip in order to thread the tail without the need for threading ropes.

SUMMARY OF THE INVENTION

The present invention relates to a drying apparatus and method for drying a web of paper. The apparatus includes a plurality of drying sections for drying the web. Each of the drying sections includes a plurality of dryers which are disposed in a single tier configuration. A plurality of vacuum transfer rolls are disposed such that each vacuum roll is located between adjacent dryers of the plurality of dryers. A dryer felt extends alternately around each dryer and each vacuum roll such that each of the dryers is top felted so that broke removal is facilitated.

Each of the drying sections is arranged in succession such that the web is restrained against cross-machine and machine directional shrinkage during passage of the web through the plurality of drying sections.

A further single drying section only is disposed downstream relative to the plurality of drying sections such that the web extends between the plurality of drying sections and the further drying section.

The further drying section includes an upper tier of dryers and an upper plurality of rolls disposed between adjacent dryers of the upper tier. An upper felt extends alternately around each dryer of the upper tier and each roll of the upper plurality of rolls.

The further drying section also includes a lower tier of dryers and a lower plurality of rolls which are disposed between adjacent dryers of the lower tier. A lower felt extends alternately around each dryer of the lower tier and each roll of the lower rolls. The arrangement is such that the web extends in open draw between each dryer of the upper and lower tiers so that any tendency of the web to curl can be controlled during movement of the web through the further drying section by appropriate adjustment of dryer steam pressure.

In a more specific embodiment of the present invention, the plurality of drying sections includes at least four drying sections.

In a preferred embodiment of the present invention, the plurality of dryers are disposed substantially horizontally.

In the various embodiments of the present invention, the plurality of vacuum transfer rolls are each connected to a source of partial vacuum such that during movement of the web around each of the vacuum transfer rolls, the web is held against cross-machine and machine directional shrinkage, the dryer felt being disposed between the web and each of the vacuum transfer rolls.

Additionally, each of the drying sections further includes a plurality of doctors, each doctor cooperating with a dryer of the plurality of dryers for assisting in the removal of broke.

The web is transferred from one drying section of the plurality of drying sections to a succeeding section, preferably, but not necessarily, without open draw, the web being disposed between a succeeding dryer felt of a successive drying section such that the web follows the succeeding dryer felt.

The web extends without an open draw between the plurality of drying sections and the further drying section when the web has attained a dryness of at least 65 percent dry and preferably at least 80 percent dry.

In one embodiment of the present invention, the plurality of drying sections further include a downstream vacuum roll, and the further single drying section also includes an upstream vacuum roll which is disposed adjacent to and downstream relative to the downstream vacuum roll. The arrangement is such that the web is sandwiched between the dryer felt of the plurality of drying sections and the lower felt so that the web is transferred from the dryer felt to the lower felt without open draw.

In an alternative embodiment of the present invention, the plurality of drying sections further include a downstream felt roll and a blow box disposed adjacent to a dryer felt and immediately upstream relative to the felt roll.

Additionally, the further single drying section also includes an upstream felt roll disposed closely adjacent to the dryer felt and upstream relative to the downstream felt roll.

A further blow box is disposed closely adjacent to and downstream relative to the downstream felt roll such that the web is sandwiched between the dryer felt and the lower felt. The arrangement is such that the web is transferred without open draw from the dryer felt to the lower felt.

In a preferred embodiment of the present invention, at least some rolls of the upper plurality of rolls are offset towards an adjacent upstream dryer of the upper tier of dryers for reducing the distance of the open draw between each dryer of the upper and lower tiers.

Additionally, each roll of the lower plurality of rolls are offset towards an adjacent upstream dryer of the lower tier of dryers such that the open draw between each dryer of the lower and upper tiers is minimized.

The present invention also includes control means for controlling the steam pressure within each dryer of the upper and lower tier of dryers so that any tendency of the web to curl due to cross-machine directional shrinkage of the web is compensated for by the application of differential steam pressure between succeeding dryers.

Many modifications and variations of the present invention will be readily apparent to those skilled in the art by a consideration of the detailed description contained hereinafter, taken in conjunction with the annexed drawings. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE INVENTION

Figure 1:
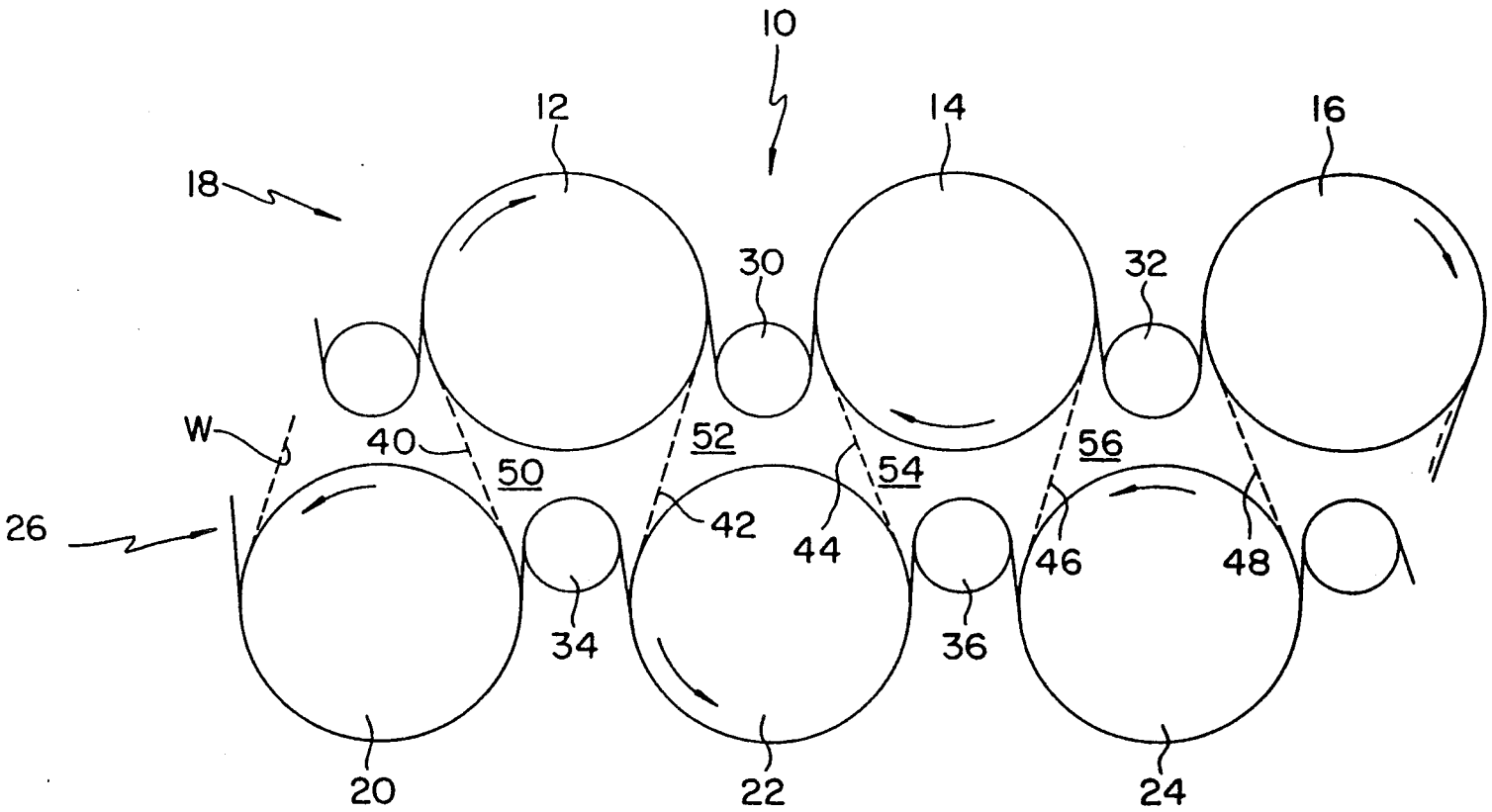
FIG. 1 PRIOR ART
FIG. 1 is a side-elevational view of a prior art two tier, double felted drying section.

FIG. 1 is a side-elevational view of a typical two tier, double felted drying section, generally designated 10, including dryers 12, 14 and 16 arranged as an upper tier, generally designated 18, and dryers 20, 22 and 24 arranged as a lower tier, generally designated 26.

Rolls 30 and 32 are disposed closely adjacent to and between adjacent dryers of the upper tier 18.

Rolls 34 and 36 are disposed closely adjacent to and between adjacent dryers of the lower tier 26.

As can be seen from FIG. 1, the web W, as indicated by a dashed line, moves in an open draw 40, 42, 44, 46 and 48 alternately between dryers of the upper and lower tiers 18 and 26, respectively.

Additionally, water vapor evaporating from the web W becomes trapped within the pocket areas 50, 52, 54 and 56 causing uneven drying of the resultant web.

Figure 2:
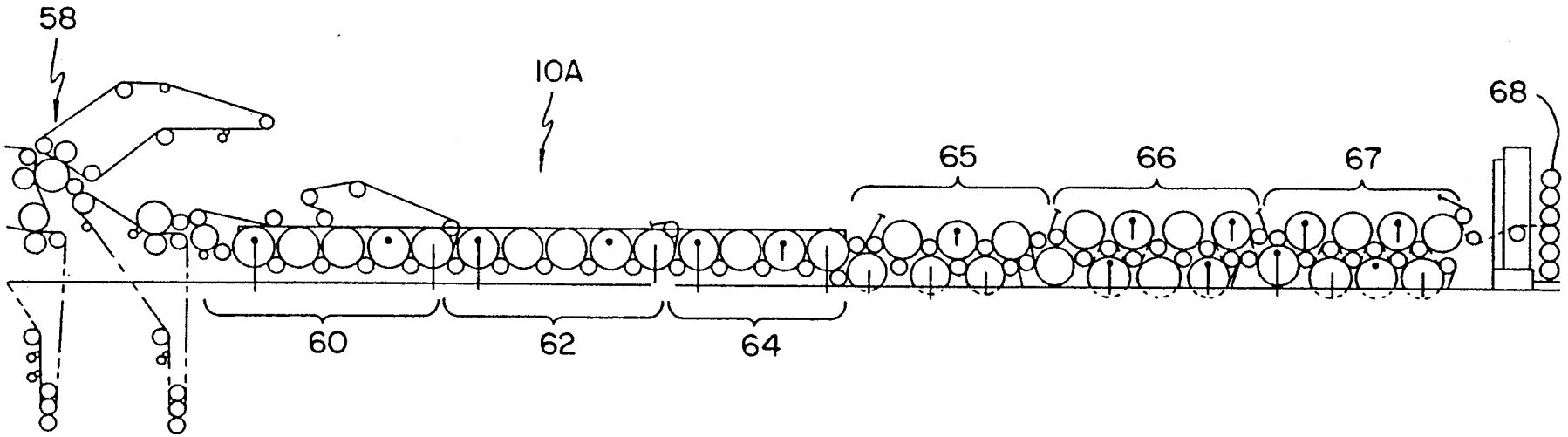
FIG. 2 PRIOR ART
FIG. 2 is a side-elevational view of a prior art extended BelRun dryer section which includes a plurality of top felted, single tier drying sections followed by a plurality of double felted, two tier dryer sections.

FIG. 2 is a side-elevational view of an extended Bel-Run dryer section, generally designated 10A, which includes a press, generally designated 58, followed by a plurality of top felted, single tier drying sections 60, 62 and 64.

The top felted drying sections 60, 62 and 64 are followed by a plurality of double felted, two tier sections 65, 66 and 67 followed by a calender 68.

Figure 3:
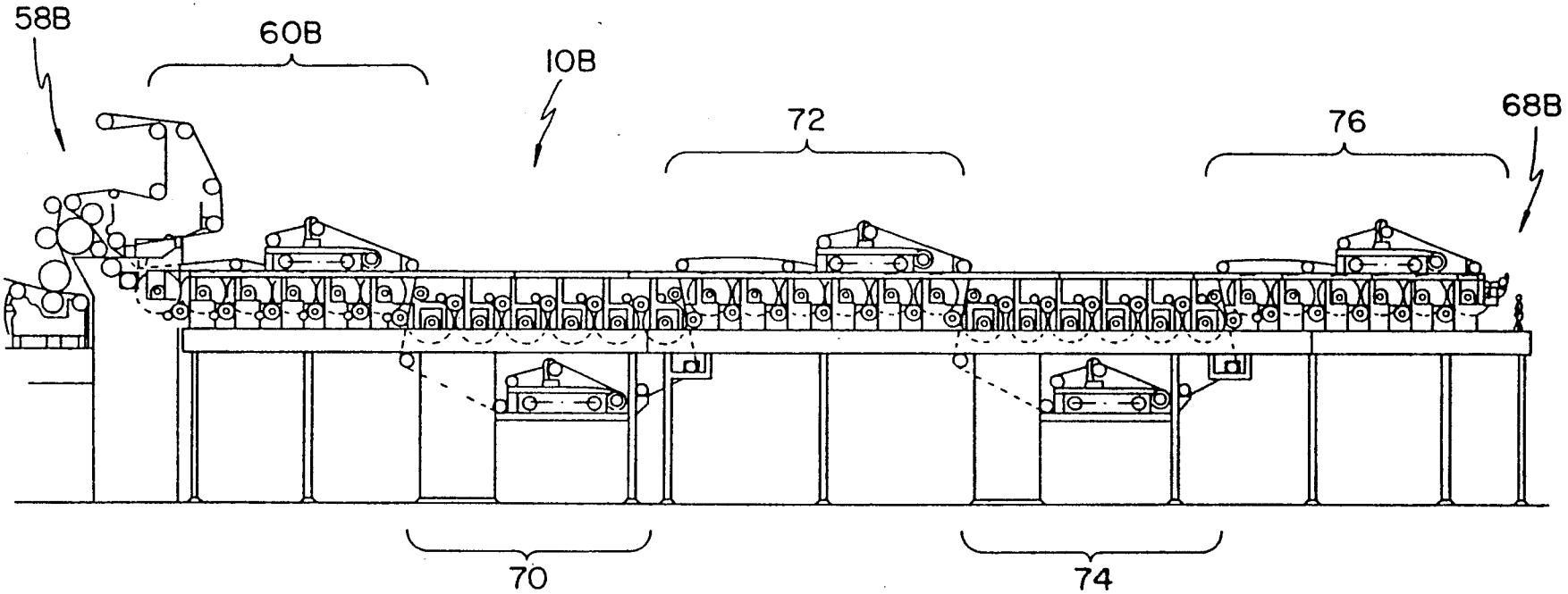
FIG.3 PRIOR ART
FIG. 3 is a side-elevational view of a prior art BelChamp TM dryer section including alternate top and bottom felted dryer sections for drying alternate sides of the web.

FIG. 3 is a side-elevational view of a prior art Bel-Champ TM dryer section generally designated 10B. The dryer section 10B includes a top felted, single tier drying section 60B followed by a bottom felted, single tier drying section 70 for drying the opposite side of the web.

During movement of the web through the Bel-Champ TM dryer section 10B, alternate sides of the web are dried during movement of the web through succeeding dryer sections 70, 72, 74 and 76, the web being restrained against machine and cross-machine directional shrinkage during movement of the web from a press 58B to a calender end, generally designated 68B.

Figure 4:
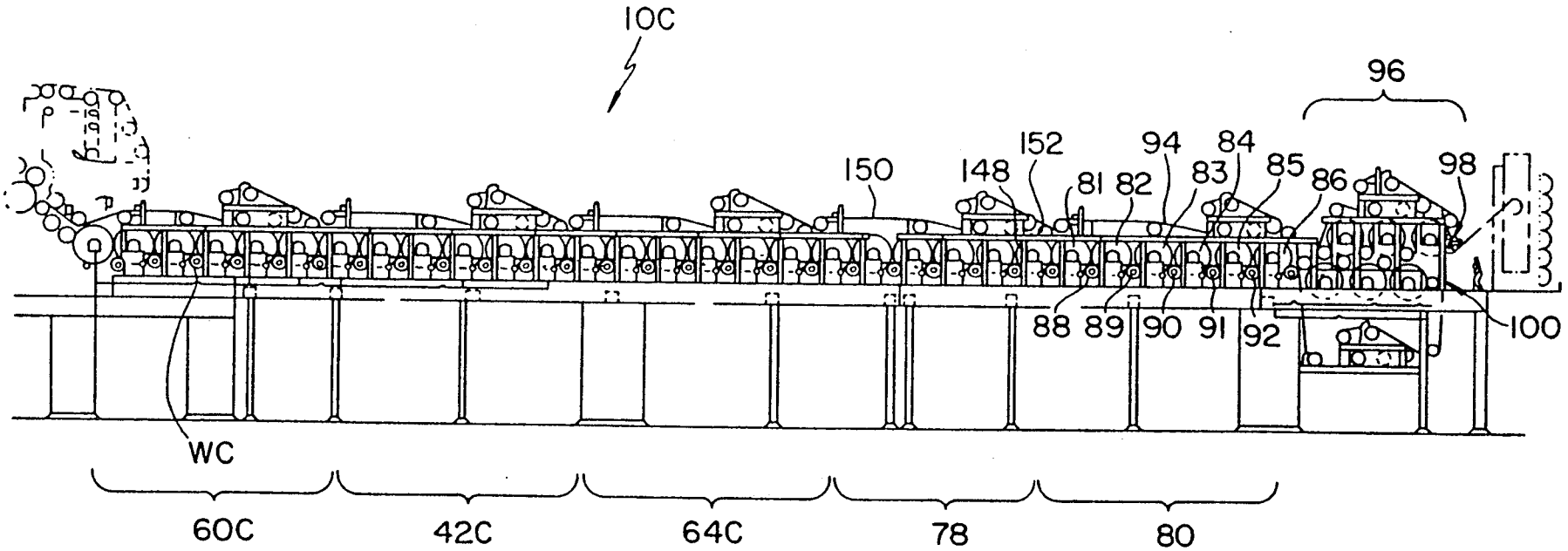
FIG. 4 is a side-elevational view of the drying apparatus according to the present invention showing a plurality of top felted, single tier drying sections followed by a single, double felted drying section.

FIG. 4 is a side-elevational view of a drying apparatus, generally designated 10C according to the present invention, for drying a web of paper WC. The apparatus 10C includes a plurality of drying sections 60C, 62C, 64C, 78 and 80 for drying the web WC.

Each of the drying sections 60C, 62C, 64C, 78 and 80 includes a plurality of dryers. For example, drying section 80 includes dryers 81, 82, 83, 84, 85 and 86 which are disposed in a single tier configuration.

Also, a plurality of vacuum transfer rolls 88, 89, 90, 91 and 92 are arranged with each vacuum roll 88 to 92 being disposed between adjacent dryers of the plurality of dryers 81 to 86.

A dryer felt 94 extends alternately around each dryer 81 to 86 and each vacuum roll 88 to 92. The arrangement is such that each of the dryers 81 to 86 is top felted so that broke removal is facilitated.

Each of the drying sections 60C, 62C, 64C, 78 and 80 is arranged in succession and preferably, but not exclusively, without any open draw between successive drying sections. The arrangement is such that the web WC is restrained against cross-machine and machine directional shrinkage during passage of the web WC through the plurality of drying sections 60C, 62C, 64C, 78 and 80.

A further single drying section only, generally designated 96, is disposed downstream relative to the plurality of drying sections 60C, 62C, 64C, 78 and 80 such that the web WC extends preferably, but not exclusively, without an open draw between the plurality of drying sections 60C, 62C, 64C, 78 and 80 and the further drying section 96.

Figure 5:
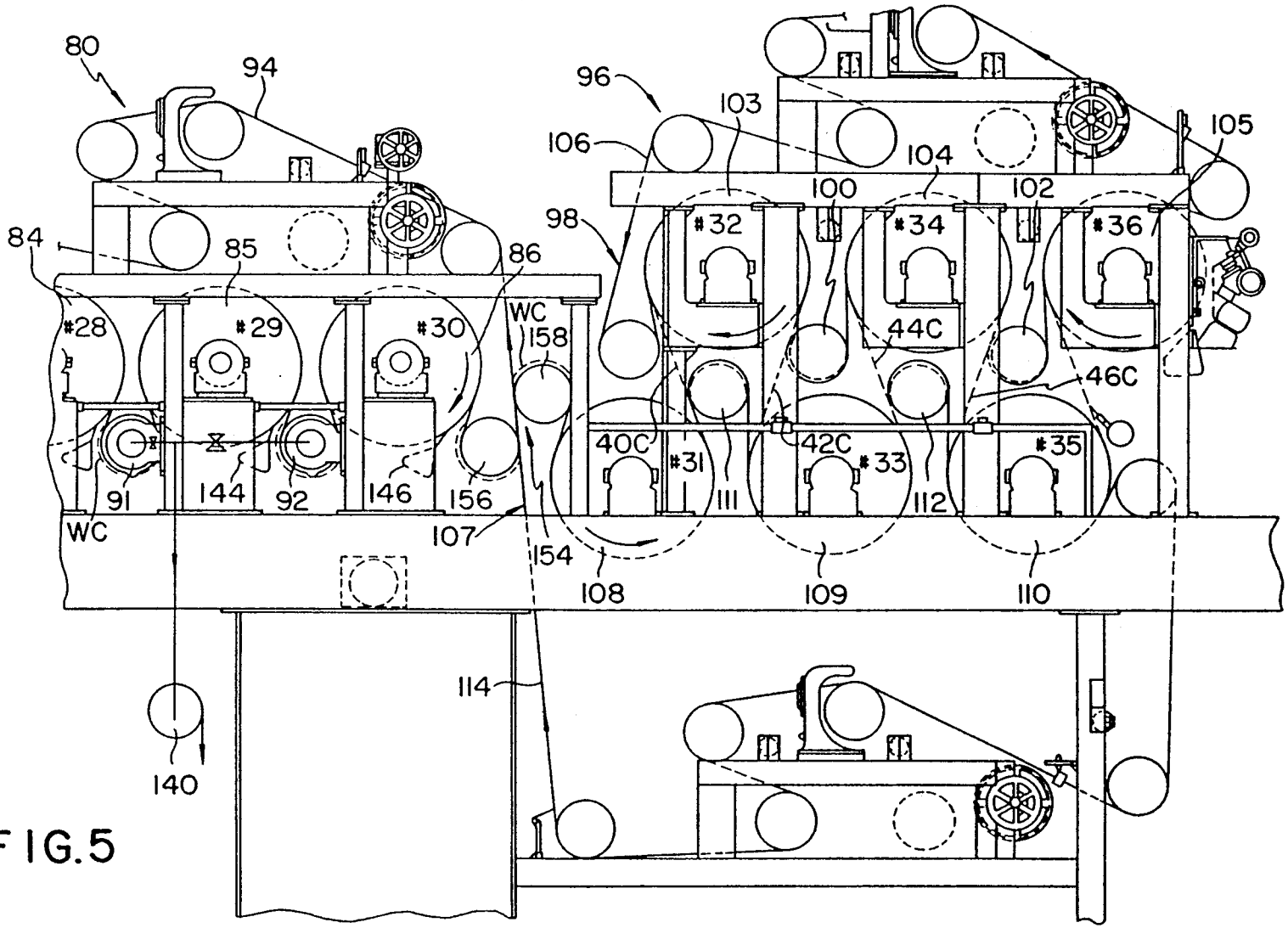
FIG. 5 is an enlarged view of the transfer between the top felted drying sections to the single, double felted drying section shown in FIG. 4.

FIG. 5 is an enlarged view of the transfer to the further drying section 96.

The further drying section 96 includes an upper tier of dryers, generally designated 98, and an upper plurality of rolls 100 and 102 disposed between adjacent dryers 103, 104 and 104, 105 of the upper tier 98.

An upper felt 106 extends alternately around each dryer 103 to 105 of the upper tier 98 and each roll 100 to 102 of the upper plurality of rolls.

The further drying section 96 also includes a lower tier 107 of dryers 108, 109 and 110 and a lower plurality of rolls 111, 112 which are disposed between adjacent dryers 108, 109 and 109, 110 of the lower tier 107.

A lower felt 114 extends alternately around each dryer 108 to 110 of the lower tier 107 and each roll 111 to 112 of the lower rolls. The arrangement is such that the web WC extends in open draw 40C, 42C, 44C and 46C between each dryer of the upper and lower tiers 98 and 107, respectively, so that any tendency of the web WC to curl is controlled during movement of the web WC through the further drying section 96.

As shown in FIG. 4, the plurality of drying sections includes five drying sections 60C, 62C, 64C, 78 and 80, such drying sections being disposed substantially horizontally.

As shown in FIG. 5, the plurality of vacuum transfer rolls 91 to 92 are each connected to a source of partial vacuum 140 such that during movement of the web WC around each of the vacuum transfer rolls 91 to 92, the web WC is held against cross-machine and machine directional shrinkage, the dryer felt 94 being disposed between the web WC and each of the vacuum transfer rolls 91 and 92.

As shown in FIG. 5, each of the drying sections, for example 80, further includes a doctor 144 and 146 which cooperate with each dryer 85 to 86 of the plurality of dryers for assisting in the downward removal of broke.

The web WC, as shown in FIG. 4, is transferred from one drying section, for example 78, to a succeeding section, for example 80, preferably without open draw.

The web is disposed between the succeeding dryer felt 94 of the successive drying section 80 such that the web WC follows the succeeding dryer felt 94.

More specifically, such transfer without open draw is accomplished by a lick-down transfer, which is well-known in the art and which includes supporting the web WC on the heated surface of a drying cylinder 148 (FIG. 4), a dryer felt 150 having been guided away from the drying cylinder 148 by a felt roll 152. The succeeding dryer felt 94 is guided into contact with the web WC supported by the drying cylinder 148 such that the web WC is transferred to the succeeding felt 94, as is well-known in the art.

The web WC extends preferably without an open draw between the plurality of drying sections 60C, 62C, 64C, 78 and 80 and the further drying section 96 when the web has attained a dryness of at least 65 percent and preferably has attained a dryness of at least 80 percent dry.

FIG. 5 shows a transfer, generally designated 154, between the plurality of drying sections 60C, 62C, 64C, 78 and 80 and the further single drying section 96.

More specifically, as shown in FIG. 5, the drying section 80 also includes a downstream vacuum roll 156. The further single drying section 96 also includes an upstream vacuum roll 158 which is disposed adjacent to and downstream relative to the downstream vacuum roll 156. The arrangement is such that the web WC is sandwiched between the dryer felt 94 of the plurality of drying sections and the lower felt 114 such that the web WC is transferred from the dryer felt 94 to the lower felt 114 without open draw.

Figure 6:
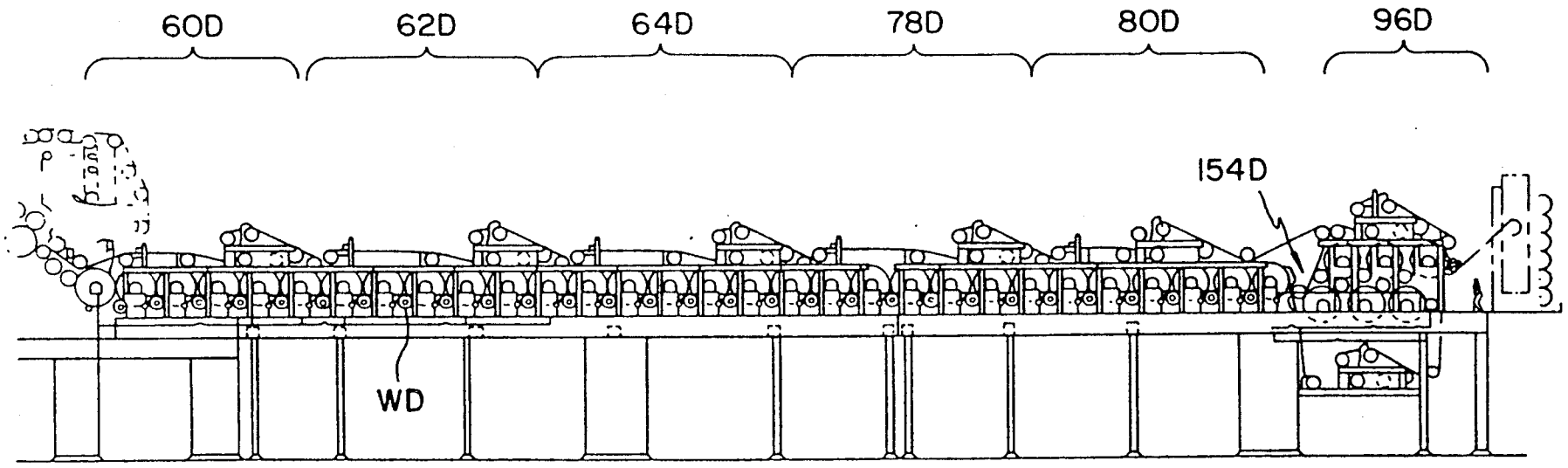
FIG. 6 is a similar view to that shown in FIG. 4 but shows an alternative embodiment of the present invention having a transfer means for transferring the web from the single felted sections to the double felted sections using blow boxes.

FIG. 6 is a side-elevational view showing an alternative transfer arrangement, generally designated 154D, for transferring a web WD from a plurality of drying sections 60D, 62D, 64D, 78D and 80D to a further single drying section 96D.

Figure 7:
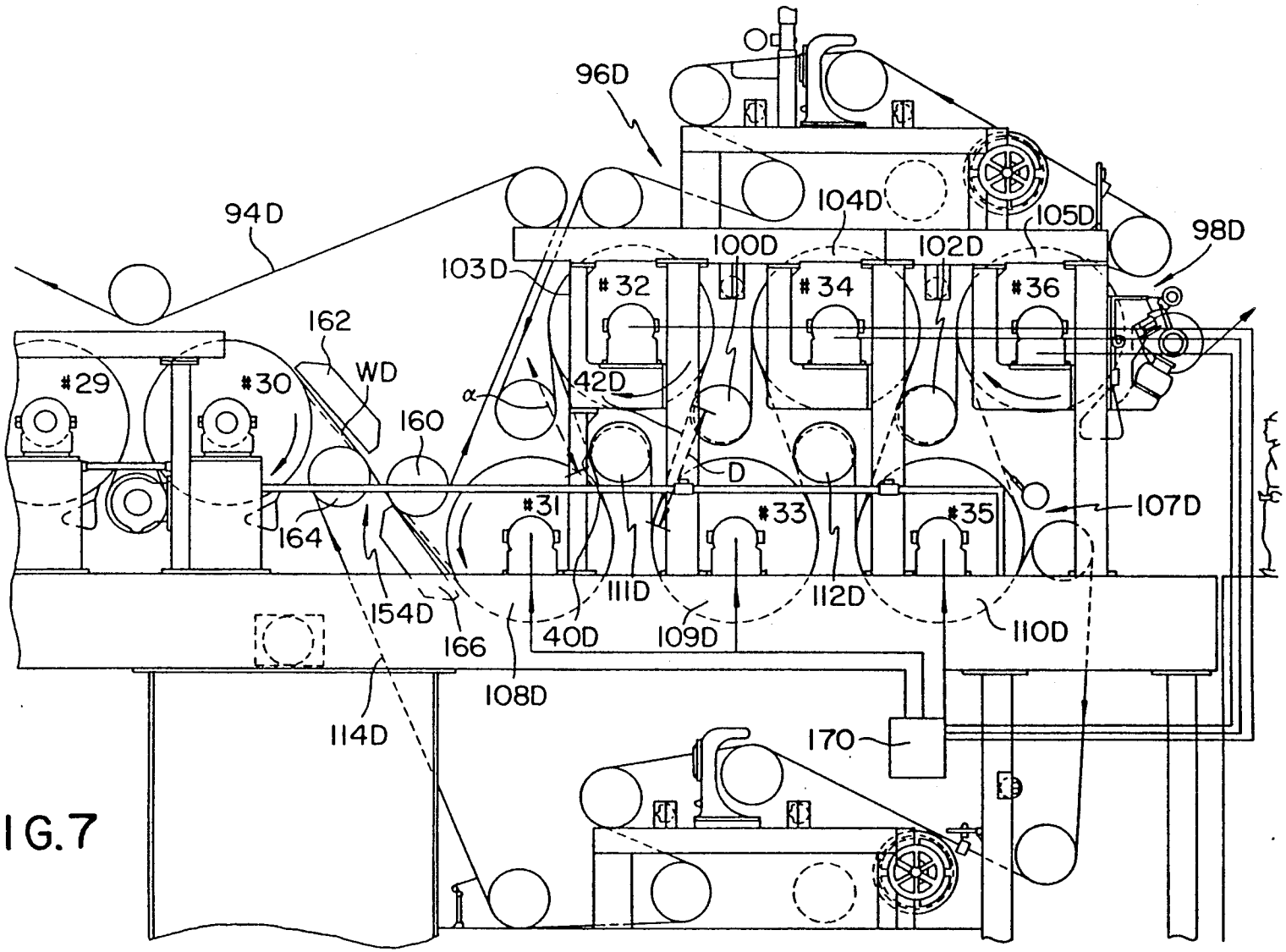
FIG. 7 is an enlarged view of the transfer means shown in FIG. 6.

FIG. 7 is an enlarged view of the transfer 154D shown in FIG. 7 and includes a downstream felt roll 160 and a blow box 162 disposed adjacent to a dryer felt 94D and immediately upstream relative to the felt roll 160. The further single drying section 96D also includes an upstream felt roll 164 disposed closely adjacent to the dryer felt 94D and upstream relative to the downstream felt roll 160.

A further blow box 166 is disposed closely adjacent to and downstream relative to the downstream felt roll 160 such that the web WD is sandwiched between the dryer felt 94D and a lower felt 114D. The arrangement is such that the web WD is transferred without open draw from the dryer felt 94D to the lower felt 114D.

As shown in FIG. 7, at least some rolls 100D and 102D of the upper plurality of rolls are offset towards adjacent upstream dryers 103D and 104D, respectively, of an upper tier 98D of dryers for reducing a distance D of the open draw 42D between each dryer 103D and 109D of the upper and lower tiers 98D and 107D, respectively.

Additionally, each roll 111D and 112D of the lower plurality or rolls is offset towards an adjacent upstream dryer 108D and 109D of the lower tier 107D of dryers such that the open draw 40D between each dryer 108D and 103D of the lower and upper tiers 107D and 98D, respectively, is minimized, as indicated by the distance "d".

As shown in FIG. 7, the further single drying section 96D also includes control means 170 for controlling the steam pressure within each dryer 103D, 104D and 105D of the upper tier 98D and each dryer 108D, 109D and 110D of the lower tier 107D of dryers so that any tendency of the web WD to curl due to cross-machine directional shrinkage of the web is compensated for by the application of differential steam pressure between succeeding dryers.

Figure 8:
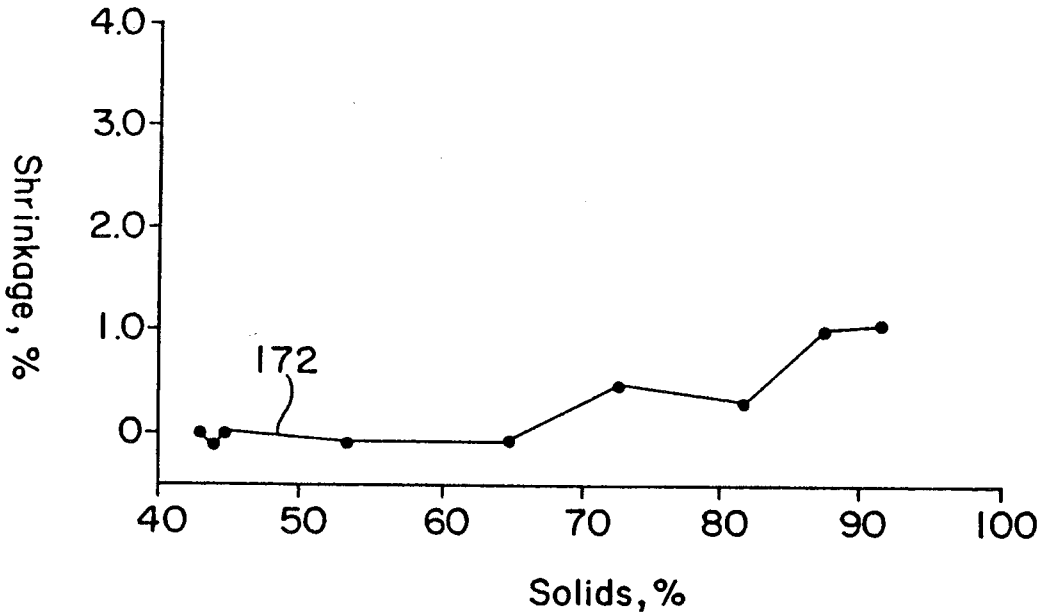
FIG. 8 is a graph generated from the results of trials showing the percentage of solids within the dried web relative to the percentage of shrinkage in a cross-machine direction of the web.
Figure 9:
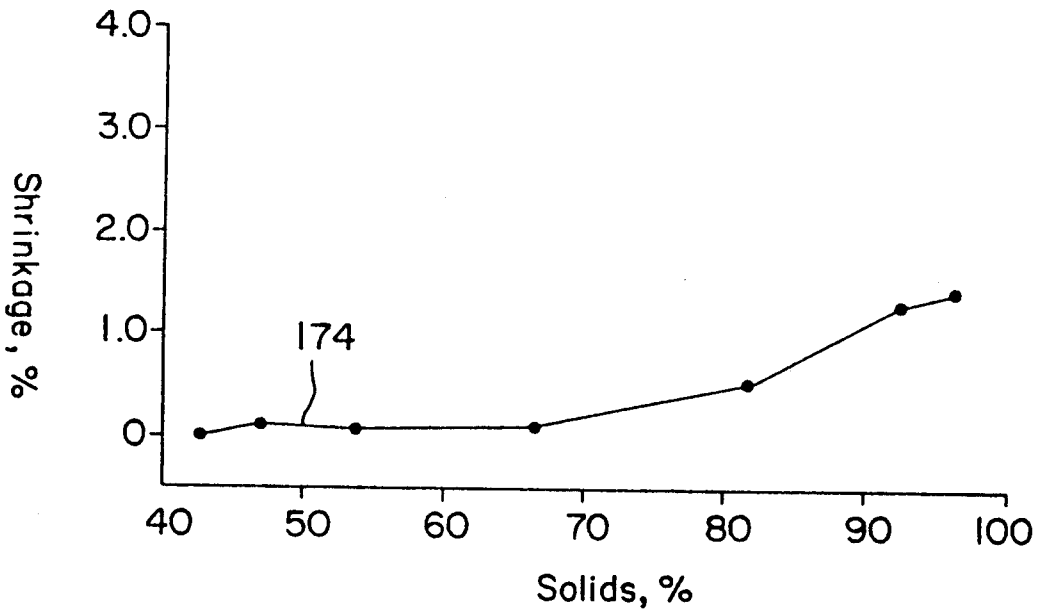
FIG. 9 is a graph similar to that shown in FIG. 8 but showing the results of trials for a wood-free coated machine.

FIGS. 8 and 9 show graphs 172 and 174, respectively, representing results obtained from commercial installations of the Bel-Champ TM type drying section.

Figure 10:
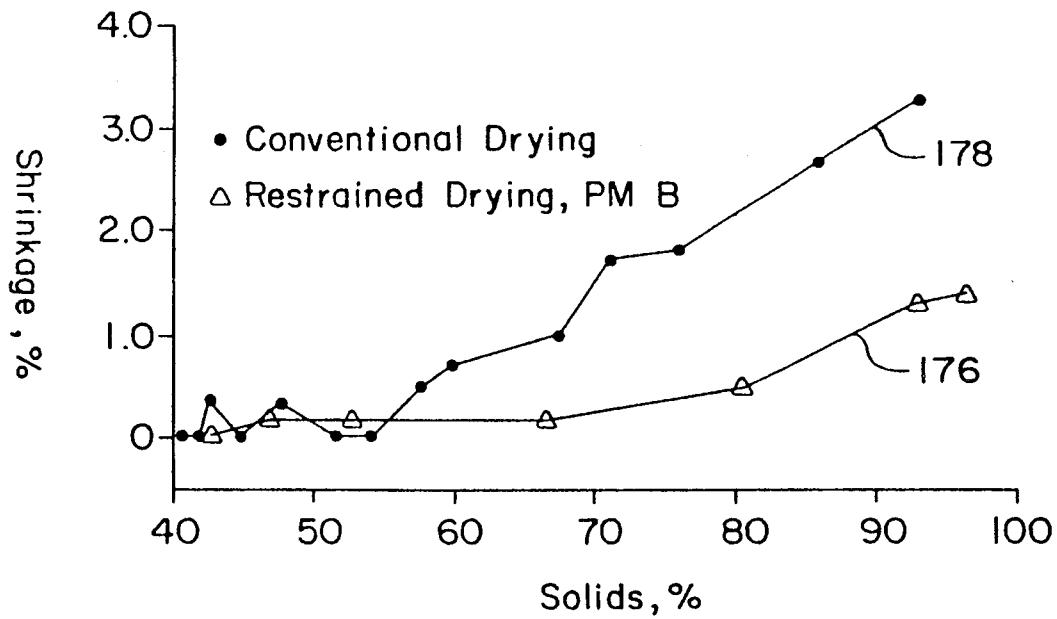
FIG. 10 is a graph showing a comparison between results obtained from a Bel-Champ TM drying section and a conventional double felted drying section indicating that the amount of cross-machine directional shrinkage in the Bel-Champ TM arrangement remains approximately zero (0) until at least 65 percent dry.

FIG. 10 shows two graphs with the first graph 176 obtained from results from a Bel-Champ TM type drying section and showing that the cross-machine directional shrinkage remains substantially zero (0) until the web reaches a dryness of approximately 65 percent dry.

The other graph 178 shows the results taken from trials conducted using a conventional two tier, double felted drying arrangement showing cross-machine directional shrinkage rapidly increasing as the web attains approximately 55 percent solids, that is 55 percent dry.

The present invention provides the advantages of an all single felted, top felted dryer arrangement, therefore avoiding the problem of broke removal associated with bottom felted, single tier sections.

A single two tier section is used at the dry end, and all the transfers are accomplished on the operating floor level.

Also, all of the transfers between dryer sections are preferably closed draws until the web enters the two tier, double felted section.

The two tier section is utilized only after the web has attained a dryness of preferably over 80 percent when the effects of the Bel-Champ TM arrangement becomes less effective.

Although specific minimal dryness levels have been specified, it will be appreciated by those skilled in the art that different grades of paper tend to curl at different dryness levels.

More particularly, according to the present invention, the two tier dryer section is located such that the web extends therethrough when the web has reached a particular critical moisture content. Such critical moisture content corresponds to that point at which the sheet has sufficient strength to be transferred through open draws, where the machine direction draws required to maintain good runnability are low, and where the cross-machine directional shrinkage would begin to occur, even when dried with a Bel-Champ TM type dryer section. It is this latter criteria which will most often dictate the transition point.

The aforementioned critical moisture content is not a fixed value of, for example, 65 percent dry. The value will depend on various properties of the pulp from which the sheet is being made. These properties dictate the resultant sheet wet and dry strengths, the shrinkage tendency, and the point at which unrestrained cross-machine directional shrinkage begins.

For purposes of the present invention, however, the sheet moisture content, which must be reached before the single tier drying section can end and the two tier section can be used, is based on the water retention value (WRV) of the pulp. Pulps with higher WRVs will begin to shrink at a much lower web dryness than pulps with lower WRVs, and such shrinkage will be of a larger magnitude.

The critical moisture content for unrestrained webs has been measured and reported in "Effect of Water Retention Value (WRV) on the Paper Web Drying Process" by K. Przybysz and J. Czechowski in Cellulose Chem Technology, Volume 20, Pages 451–464, published in 1986.

The equation for the critical moisture (paper dryness) is:

$$M = 81 - 0.246\ (WRV)$$

However, the aforementioned formula relates to unrestrained drying.

In the aforementioned formula, WRV is the water retention value expressed in percent, and M is the critical moisture content at which shrinkage begins, expressed in percent dry.

However, it should be noted that the aforementioned equation is somewhat conservative in that it gives the critical moisture for a sheet that is drying without shrinkage restraint. The critical sheet dryness for a partially restrained web will be higher, so the sheet dryness for the Bel-Champ TM dryer section, according to the present invention, should also be higher.

Therefore, for restrained drying, the critical moisture content is very approximately 20 percentage points higher than the unrestrained shrinkage point.

Consequently, Applicants discovered that the critical moisture content (paper dryness) for the Bel-Champ TM followed by a two tier section would be ascertained from the equation $M = 101 - 0.246$ (WRV).

In the aforementioned specific embodiments of the present invention, the dryers are all arranged with the section-to-section transfers located for direct access from the main operating floor. The aforementioned transfers include the press-to-dryer section transfer, the dryer-to-dryer section transfer, and the dryer-to-calender section transfer.

In a preferred embodiment of the present invention, five single tier, top felted sections consist of six dryers each. However, such sections can include six to nine dryers each.

The dryer cylinders extend generally horizontally, and are located above the operating floor at a height which makes them all directly accessible by the machine operators from the operating floor.

The dryer hood, which is not shown in FIG. 4, remains below the height of the press section.

A series of top felted sections shown in FIG. 4 is followed by a single, two tier dryer section which, as stated hereinbefore, is used to provide direct control of curl at the very end of the dryer section. Such control is maintained by differential adjustment of the steam pressures in the top and bottom dryers. The two tier section also increases the number of dryers that can be located in the available building length. The further dryer section also provides an open draw location for installing a tail cutter.

Common to the various alternative and preferred embodiments of the present invention is the fact that all of the single tier dryer sections are top felted. Furthermore, all of the broke handling and removal from such top felted sections is done in a downward direction.

In the preferred embodiment of the present invention, the transfer between the last single tier section and the two tier section is accomplished using two vacuum rolls and a joint run of the two fabrics or felts to accomplish a stable transfer of the web.

In the alternative embodiment of the present invention, the transfer between the last single tier section and the two tier section is accomplished using two felt rolls and one or more blow boxes with two overlapping felts. Such an arrangement allows a stable transfer of the web but a longer distance between the cylinders is required.

The present invention also envisages a transfer between the single felted drying sections and the double felted section by means of an open draw transfer.

In the two tier dryer section, each felt roll is located in an offset position relative to the center line between adjacent dryers, with the felt rolls being offset towards the wet end of the machine. The offset is adjusted so that the felt roll surfaces near the tangent point of the web run from one dryer to the next. Intermediate felt rolls could be plain rolls used in combination with ventilating blow boxes, PV rolls, or preferably rolls of the Beloit BelVent TM design. BelVent TM rolls have two internal chambers, one for directing ventilation air into the dryer pocket, and the other for exhausting humid air from the dryer pockets. Such BelVent TM rolls can be used to ventilate the dryer pockets, thereby keeping the pockets in flow balance and thereby stabilizing the transfer of the wet web.

In the two tier drying section, the open draw can be used for the disposition therein of a tail cutter.

The present invention also includes the method steps of passing the web through a plurality of drying sections for drying the web until the web is at least 65 percent dry, each of the drying sections being a top felted, single tier drying section for facilitating downward removal of broke; and subsequently drying both sides of the web in order to inhibit curl in the resultant web. Preferably, the web is dried to within the range 75 to 80 percent dry prior to the step of drying both sides of the web.

It will be understood by those skilled in the art that the step of drying the web from both sides includes, alternatively, hot air impingement, and two tier, single or double felted drying arrangements, or drying alternate sides of the web by moving the web through alternate top and bottom felted, single tier drying sections.

The present invention particularly relates to the direct effect of extending single-sided drying on the curl behavior of the web. More specifically, two-sided drying should be started at that point at which curl control is still effective enough to avoid curl in the finished sheet.

In the prior art arrangements, it was well-known that the sheet tends to curl towards the last side of the web to be dried, at least in laboratory studies. To be sure that both sides dry at the same time, both sides have been dried alternately, beginning in the very early stages of drying.

Concern about sheet curl led dryer section builders to dry alternate sides even in the very early stages in the Bel-Champ TM dryer sections. For example, the #3 machine at CTS, Duino, Italy, was designed with the first three dryers top felted, the next three bottom felted, and the following three top felted. These first three sections were designed this short to ensure alternate-sided drying would be started in the very early stages of the drying process.

Recent studies, however, have shown that the sheet curl is comprised of reversible and irreversible components. Only the irreversible component is affected by the drying. Variations in the reversible component (sheet structure two-sidedness) has confused the evaluation of sheet curl in the past.

Applicants now recognize, according to the present invention, that a sheet may curl towards the first side dried, if the reversible curl component is large enough in that direction. Applicant has also now recognized that curl control is most effective at the end of the dryer section, where the final dryness is being achieved.

Additionally, Applicants further recognized that some evaporation occurred from the opposite side that contacted the dryer. Such drying can be particularly significant for lightweight paper grades, such as newsprint, fine paper and lightweight coated paper (LWC).

Applicants also recognized that the early dryers were used primarily for preheating the web. Further, the early dryers often used lower steam pressures in the cylinders to avoid picking.

Based on the aforementioned factors, Applicants now recognize that the web may contact several dryers on one side first, before alternate-side drying is required to maintain low curl. Such is because the dryer steam pressures are lower, and much of the energy is used for preheating, and some evaporation will occur from the opposite side in those dryers in the initial portion of the dryer section.

Furthermore, and most importantly, Applicants have discovered that the dryness can be increased even further than what might be suggested from the aforementioned factors alone. This is because the curl control is most effective at the end of the dryer section. Very little shrinkage of either the individual fibers or the fiber networks occur at the wet end of the dryer section. The majority of the shrinkage forces are developed after the web has reached a lower moisture content. As a result, the web can be dried down to this lower moisture from one side only, without creating a problem with sheet curl.

Because of the complexities associated with shrinkage and the drying process, and the furnish factors, it is difficult to accurately analytically predict the critical moisture content. The critical moisture content will be different for different grades and furnishes.

One alternative approach to determining the critical moisture content is to measure the effect of single-sided drying directly. Such was performed recently using a 64 grams per square meter (64 gsm) sheet made on a pilot paper machine. The sheets were dried from one side for a specific number of drying cycles before reversing the side of drying. Sheet curl was measured at the end of the drying process.

Significant curl was seen as the single-sided drying extended to above 65 to 80 percent dry.

Due to the number of variables that can influence the critical moisture (furnish, drying rate, basis weight, etc), the critical moisture has been recognized by Applicants to be at least 65 percent dry, with the preferred range being between 70 and 85 percent dry.

The present invention provides an arrangement in which each of the single felted drying sections are top felted, and in which only one two tier section is used following the top felted section. All of the transfers are on the operating floor level, and each of the transfers between the single tier drying sections is by means of closed draw transfer. The two tier drying section includes pocket felt rolls which are offset, and most importantly, the two tier section is used only after the web reaches a critical dryness level, after which the two tier section is used to finally dry the web and to control any tendency of the web to curl.

What is claimed is:

1. A drying apparatus for drying a web of paper, said apparatus comprising:

a plurality of drying sections for drying the web;

each of said drying sections including:

a plurality of dryers disposed in a single tier configuration;

a plurality of vacuum transfer rolls, each vacuum roll being disposed between adjacent dryers of said plurality of dryers;

a dryer felt extending alternately around each dryer and each vacuum roll, the arrangement being such that each of said dryers is top felted so that broke removal is facilitated, each of said drying sections being arranged in succession;

a further single drying section only disposed downstream relative to said plurality of drying sections such that the web extends between said plurality of drying sections and said further drying section;

said further drying section including:

an upper tier of dryers;

an upper plurality of rolls disposed between adjacent dryers of said upper tier;

an upper felt extending alternately around each dryer of said upper tier and each roll of said upper plurality of rolls;

a lower tier of dryers;

a lower plurality of rolls disposed between adjacent dryers of said lower tier;

a lower felt extending alternately around each dryer of said lower tier and each roll of said lower rolls, the arrangement being such that the web extends in open draw between each dryer of said upper and lower tiers so that any tendency of the web to curl is controlled during movement of the web through said further drying section; and said further single drying section further including:

control means for controlling the stem pressure within each dryer of said upper and lower tier of dryers so that any tendency of the web to curl due to excessive drying from one of the sides of the web is compensated for by the application of differential steam pressure between succeeding dryers.

2. A method for drying a web of paper, the method comprising the steps of:

restraining the web against cross-machine and machine directional shrinkage during passage of the web through a plurality of top felted, single tier drying sections, the arrangement being such that broke removal is facilitated during passage of the web through the plurality of drying sections;

subsequently drying the web during movement of the web through a two tier, double felted further drying section disposed immediately downstream relative to the plurality of drying sections, the web extending in open draw between an upper and a lower tier of dryers of the further drying section so that any tendency of the web to curl is controlled during movement of the web through the further drying section; and transferring the web from the plurality of drying sections to the further drying section when the web has attained a dryness of at least M, as represented by the formula:

$$M = 101 - 0.246\ (\mathrm{WRV})$$

in which M equals dryness of the web (critical moisture content);

and WRV equals water retention value of the web.

3. A drying apparatus as set forth in claim 1, wherein said plurality of drying sections includes at least four drying sections.

4. A drying apparatus as set forth in claim 1, wherein each of said plurality of dryers is disposed substantially horizontally.

5. A drying apparatus as set forth in claim 1, wherein said plurality of vacuum transfer rolls are each connected to a source of partial vacuum such that during movement of the web around each of said vacuum transfer rolls, the web is held against cross-machine and machine directional shrinkage, said dryer felt being disposed between the web and each of said vacuum transfer rolls.

6. A drying apparatus as set forth in claim 1, wherein each of said drying sections further includes a doctor cooperating with each dryer of said plurality of dryers for assisting in the removal of broke.

7. A drying apparatus as set forth in claim 1, wherein the web is transferred from one drying section of said plurality of drying sections to a succeeding section without open draw, the web being disposed between a succeeding dryer felt of a successive drying section such that the web follows said succeeding dryer felt.

8. A drying apparatus as set forth in claim 1, wherein the web extends between said plurality of drying sections and said further drying section when the web has attained a dryness of at least 65 percent dry.

9. A drying apparatus as set forth in claim 8, wherein the web extends when the web has attained a dryness of at least 70 percent dry.

10. A drying apparatus as set forth in claim 8, wherein the web extends when the web has attained a dryness of at least 75 percent dry.

11. A drying apparatus as set forth in claim 8, wherein the web extends when the web has attained a dryness of at least 80 percent dry.

12. A drying apparatus as set forth in claim 1, wherein said plurality of drying sections further includes:

a downstream vacuum roll;

said further single drying section further including: an upstream vacuum roll disposed adjacent to and downstream relative to said downstream vacuum roll, the arrangement being such that the web is sandwiched between a dryer felt of said plurality of drying sections and said lower felt so that the web is transferred from said dryer felt to said lower felt without open draw.

13. A drying apparatus as set forth in claim 1, wherein at least some rolls of said upper plurality of rolls are offset towards an adjacent upstream dryer of said upper tier of dryers for reducing the distance of said open draw between each dryer of said upper and lower tiers;

each roll of said lower plurality of rolls being offset towards an adjacent upstream dryer of said lower tier of dryers such that said open draw between each dryer of said lower and upper tiers is minimized.

* * * * *

UNITED STATES PATENT AND TRADEMARK OFFICE

CERTIFICATE OF CORRECTION

PATENT NO. : 5,269,074

DATED : December 14, 1993

INVENTOR(S) : Duke N. Sims, et al

It is certified that error appears in the above-identified patent and that said Letters Patent is hereby corrected as shown below:

Column 7, line 60, delete "or" and insert --of--

Column 12, line 36, delete "stem" should read --steam--

Signed and Sealed this

Third Day of May, 1994

Bruce Lehman

*Attest:*

BRUCE LEHMAN

*Attesting Officer*

*Commissioner of Patents and Trademarks*